US005217243A

United States Patent [19]

Recher et al.

[11] Patent Number: 5,217,243

[45] Date of Patent: Jun. 8, 1993

[54] SKI AND PROCESS FOR ITS MANUFACTURE

[75] Inventors: Gilles Recher, Annecy; Pierre Y. Lavorel, Chilly, both of France

[73] Assignee: Salomon S.A., Chavanod, France

[21] Appl. No.: 700,396

[22] Filed: May 15, 1991

[30] Foreign Application Priority Data

May 15, 1990 [FR] France ..... 90 06332

[51] Int. Cl.[5] ..... A63C 5/14

[52] U.S. Cl. ..... 280/610

[58] Field of Search ..... 280/610; 428/287

[56] References Cited

U.S. PATENT DOCUMENTS 5,002,300 3/1991 Pascal et al. ..... 280/610

FOREIGN PATENT DOCUMENTS 456965 11/1991 European Pat. Off. ..... 280/610

2804943 8/1979 Fed. Rep. of Germany ..... 280/610

2596286 10/1987 France ..... 280/610

2606289 5/1988 France ..... 280/610

158876 8/1985 Japan ..... 280/610

3029672 2/1988 Japan ..... 280/610

1-256985 10/1989 Japan ..... 280/610

*Primary Examiner*—Eric D. Culbreth

*Attorney, Agent, or Firm*—Pollock, Vande Sande & Priddy

[57] ABSTRACT

A ski comprising an upper decoration and protection subassembly, and a lower mechanical assembly, and the process of its manufacture. The decoration and protection sub-assembly is a double layer comprised of a polyamide, a copolymer of styrene, and either of carboxylic acid or its anhydride or a mixture containing those copolymers. This double layer can be coextruded, and it has excellent adhesive properties with the lower mechanical subassembly during the ski molding operation.

11 Claims, 2 Drawing Sheets

SKI AND PROCESS FOR ITS MANUFACTURE

FIELD OF THE INVENTION

This invention pertains to a ski and its manufacturing process.

BACKGROUND OF THE INVENTION

A ski usually displays one or more upper layers of decorations and protections against external attacks, which sometimes extend laterally to envelop the edges of the ski.

The prior art offers many solutions, the most conventional of which resides in the manufacture of an extruded A.B.S. leaf protection or of a filled thermohardening resin to which thin layers of lacquer and finishing varnish are applied. These structures have the disadvantage of weak resistance to scraping and offer only a small degree of resolution in providing of durable decorations.

Other supports have enabled the use of the sublimation process such as described in patent FR 2 596 286 which discloses the use of a two-layer film of polyamide and sequenced polyamidepolyesther. However this type of construction presents a serious problem of resistance against hot flow for certain flexible grades and of compatibility in adhesiveness with the lower subassembly which constitutes the gathering of the so-called "mechanical" elements of the ski.

It is often necessary to use gluing films like those which are described, for example, in applicant's French Patent No. 89 15662.

SUMMARY OF THE INVENTION

It is an object of this invention to provide an upper decoration and protection element, at lower cost, which resists external attacks and hot flow, and which is compatible with materials generally used in mechanical reinforcements, thus enabling the use of all the modern processes of embossing, such as, for example, sublimation.

To this end, the invention pertains to a ski that is made up of an upper decoration and protection subassembly comprising a lower layer, comprised of a copolymer of styrene and either carboxylic acid or a carboxylic acid anhydride or a mixture of those copolymers, to which adheres at least one upper layer made of a polyamide.

The invention also pertains to the process of manufacturing such a ski.

BRIEF DESCRIPTION OF THE DRAWINGS

Other objects, characteristics and advantages of this invention will emerge from the following description of several embodiments thereof, provided with reference to the accompanying drawings, in which.

DESCRIPTION OF PREFERRED EMBODIMENTS

Figure 1:
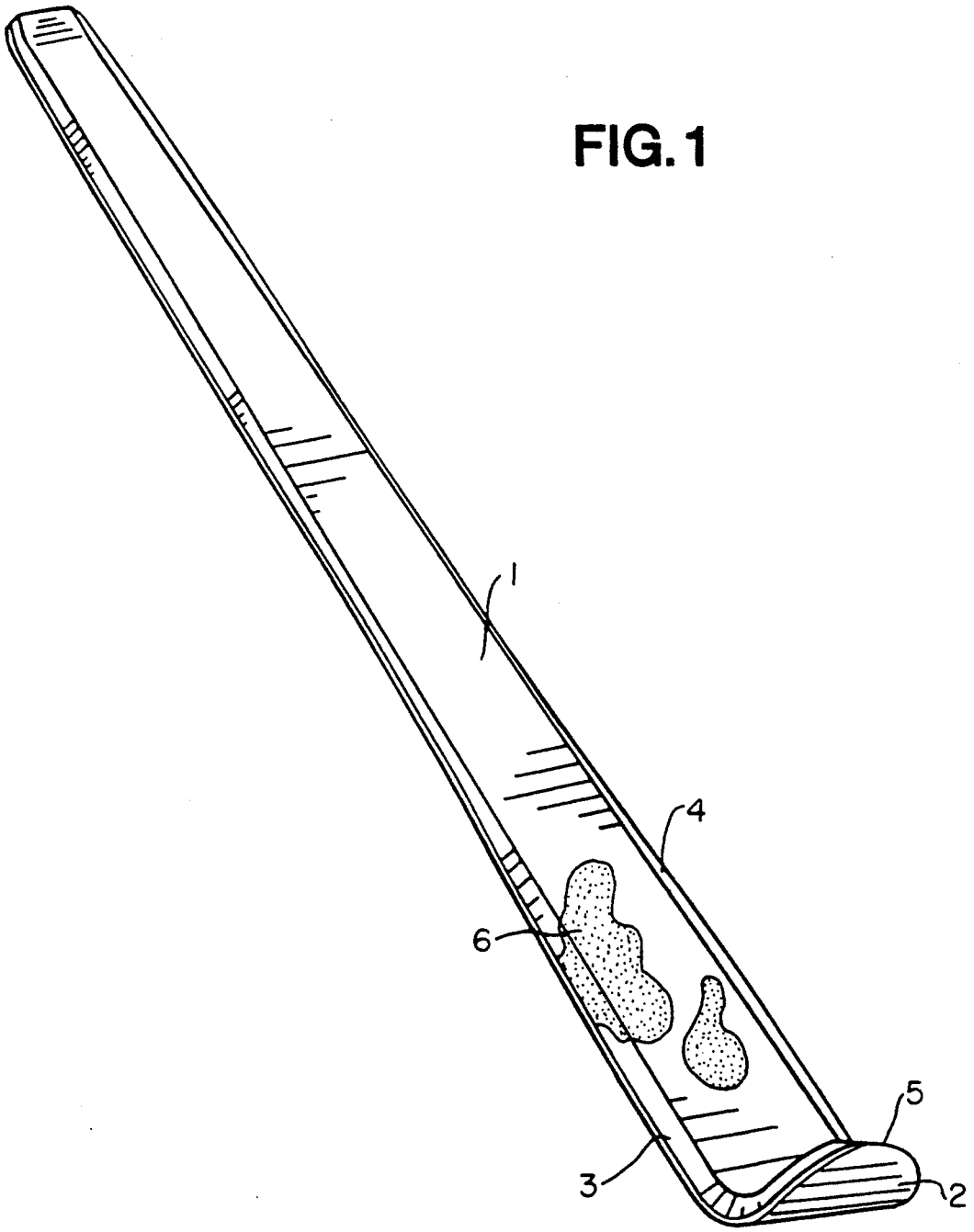
FIG. 1 is a perspective view of a ski according to the invention.

FIG. 1 shows in perspective a ski made according to the invention. Like conventional skis, this ski includes an upper face 1, a lower face 2 or sliding surface, two lateral faces 3 and 4, and a front end 5 that is bent upwardly, in the form of a spatula. A decoration 6, shown schematically, is visible from the outface on the upper face 1 and on the lateral faces 3 and 4.

Figure 2:
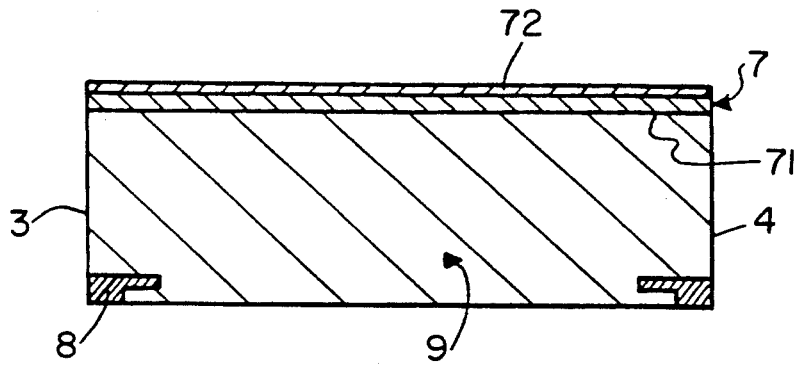
FIG. 2 shows a simplified example of a cross section of a ski according to a first embodiment of the invention.

FIG. 2 illustrates an embodiment of the ski comprising an upper decoration and protection sub-assembly 7 that is constituted of two layers 71 and 72; the lower layer 71 is made of a copolymer of styrene and either a carboxylic acid or a carboxylic acid anhydride; the upper layer 72 is made of polyamide.

The lower layer 71 is an opaque plastic material with a density close to 1, and is preferably comprised of a copolymer of styrene and, of maleic anhydride. It can eventually be modified or filled by any means known to those skilled in the art so as to augment its mechanical characteristics. Thus, the lower layer 71 may be comprised of a mixture of a copolymer of styrene and of maleic anhydride, and, for instance, an elastomer. In the kinds of fill material that are deemed suitable, glass balls, fiber of glass, of carbon or others could be used.

This copolymer displays very good adhesive capabilities with the upper layer 72. The polyamide that comprises the latter is preferably selected from among the polyamides 11 which are polyamides having 11 carbon atoms between 2 NH groups of the monomer. It is transparent, rigid and displays good resistance against external conditions. Moreover, it is easily sublimated. Each layer 71 and 72 has a thickness from 0.1 to about 1 mm.

Figure 3:
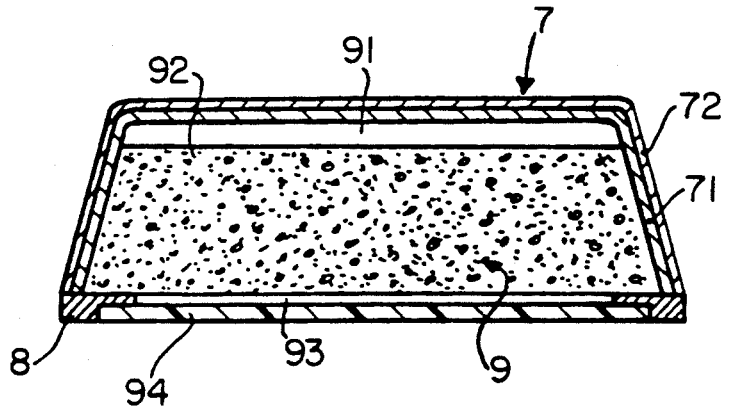
FIG. 3 shows a cross sectional view of the detailed structure of the ski according to a second embodiment of the invention.

FIG. 3 shows a sectional view of the detailed structure of a ski according to another embodiment of the invention where the upper decoration and protection unit 7 extends laterally to the level of the edges 8 and has a section whose shape is substantially that of a reversed U. This construction has the advantage of allowing the application or extending the decoration on the lateral faces 3 and 4 of the ski.

The decoration and protection sub-assembly 7 is associated with an upper reinforcement layer of the mechanical sub-assembly 9, for example, through the intermedian, of a layer of glue.

According to a preferred embodiment of the invention, the mechanical sub-assembly 9 includes an upper reinforcement layer 91 comprised of a textile reinforcement sheet and of a thermohardening matrix such as an epoxide, polyester or polyurethane resin or a thermoplastic matrix. In those specific instances, the matrix has excellent adhesive properties with the lower layer of copolymer of the decoration sub-assembly, thus obviating the need for a supplemental interface of glue.

The lower mechanical sub-assembly 9 combines all the elements needed for the ski's resistance, namely, a sliding sole 94, usually of polyethylene, edges 8, a lower reinforcement 93, a core 92, and at least one upper reinforcement layer 91. The structure shown in FIG. 3 is provided only by way of example.

The invention also relates to the process of manufacturing such a ski including assembling the upper decoration subassembly 7 with the lower mechanical subassembly 9, and includes a prior step of manufacturing the decoration sub-assembly. This step makes it possible to obtain the adhesion of the upper layer 72 made of polyamide, and the lower layer 71 made of a copolymer of styrene and of carboxylic acid or a carboxylic acid anhydride. The double layer that is obtained meets the gluing requirements that are normally recognized for a laminate in the manufacturing of a ski.

The most commonly used processes are coextrusion and hot coating with an acrylic resin. Good gluing results are obtained by coextrusion of the double layer at a temperature close to 240° C., at die relief. This operation is followed by continuous calendering, in order to define the thickness and the finish of the sub-assembly. Calendering also allows for the pursuit of adhesion kinetics for the two compounds that equals about 20 seconds at 160° C.

Finally, this prior manufacturing step includes a last decoration phase. It can be executed through sublimation as described, for example, in applicant's French Patent No. 87 13552.

The decoration sub-assembly thus formed is applied onto the lower mechanical sub-assembly 9, and especially on at least part of an upper reinforcement layer 91 of the sub-assembly. Obviously, as shown in FIG. 3, the polymer layer 71 can extend laterally beyond the reinforcement by adhering to other elements, such as bindings, edges, or others. The assembly step can preferably include a molding phase proper during which the various elements are subjected to high pressures and temperatures. The adhesion is especially efficient when the upper reinforcement layer is comprised of a pre-impregnated textile sheet of a thermohardening resin matrix, not entirely reticulated, or of a thermoplastic resin matrix.

The epoxide, polyester, or polyurethane resin matrices generally provide the best results when they are used with a styrene and maleic anhydride copolymer whether modified or not. It is the molding operation which allows for the reactivation of the final reticulation and that makes it possible to provoke adhesion in the case of a thermohardening resin matrix.

The implementation of the molding operation can be different according to the processes; an example of a manufacturing process of a ski of which the core is injected is described in applicant's French Patent No. 89 15664. Of course, the molding phase does not take effect when the elements of the mechanical sub-assembly are manufactured before, then assembled by way of gluing.

What is claimed is:

1. A ski comprising an upper decoration and protection subassembly and a lower mechanical sub-assembly, said upper subassembly comprising at least an upper layer made of a polyamide and a lower layer adhering to said upper layer, said lower layer comprising a copolymer selected from a copolymer of styrene and carboxylic acid, a copolymer of styrene and carboxylic acid anhydride and mixtures thereof.

2. A ski according to claim 1, wherein the polyamide in said upper layer 11 is comprised of a polyamide (11).

3. A ski according to claim 1 wherein said lower layer includes a copolymer of styrene and maleic anhydride in a mixture of said copolymers.

4. A ski according to claim 1, wherein said lower layer comprising said mixture of said copolymers and an elastomer.

5. A ski according to claim 1, wherein said lower layer of the upper decoration sub-assembly (1) contains fill material.

6. A ski according to claim 1, wherein the shape of a crosssection of said upper subassembly is roughly that of a reversed U.

7. A ski according to claim 1, wherein said lower layer of said upper decoration sub-assembly is in contact with an upper reinforcement layer of said lower mechanical subassembly.

8. A ski according to claim 7, wherein said upper reinforcement layer is comprised of a textile reinforcement sheet and a matrix made of one of a thermohardening and thermoplastic resin matrix.

9. A ski according to claim 8, wherein the reinforcement textile sheet is made of fibers, selected from the group consisting of glass, carbon and aramid fibers.

10. A ski according to claim 8, wherein said matrix is a thermohardening resin selected from the group consisting of epoxide, polyester, and polyurethane resins.

11. A ski according to claim 7, wherein said lower mechanical sub-assembly further includes, a sliding sole, metallic edges, a core, and a lower reinforcement layer.

* * * * *

UNITED STATES PATENT AND TRADEMARK OFFICE

CERTIFICATE OF CORRECTION

PATENT NO. : 5,217,243

DATED : June 8, 1993

INVENTOR(S) : Recher et al

It is certified that error appears in the above-identified patent and that said Letters Patent is hereby corrected as shown below:

Column 4, line 12-13,

Please delete claim 2 and rewrite to read as follows:

--2. A ski according to claim 1, wherein the polyamide in said upper layer is comprised of a polymide 11. --

Signed and Sealed this

Seventh Day of June, 1994

Bruce Lehman

*Attest:*

BRUCE LEHMAN

*Attesting Officer*

*Commissioner of Patents and Trademarks*